United States Patent [19]

Sando et al.

[11] Patent Number: 4,472,166

[45] Date of Patent: Sep. 18, 1984

[54] METHOD FOR REFORMING CELLULOSE FIBER CLOTH

[75] Inventors: Yoshikazu Sando; Eiichi Nakano, both of Wakayama, Japan

[73] Assignee: Sando Iron Works Co., Ltd., Wakayama, Japan

[21] Appl. No.: 543,456

[22] Filed: Oct. 18, 1983

[30] Foreign Application Priority Data

Oct. 18, 1982 [JP] Japan ..... 57-182265

[51] Int. Cl.[3] ..... D06M 1/14; D06M 1/22

[52] U.S. Cl. ..... 8/118; 8/116 R

[58] Field of Search ..... 8/118

[56] References Cited

U.S. PATENT DOCUMENTS

| | | | |
|---|---|---|---|
| 1,532,446 | 4/1925 | Schonholzer | 8/118 |
| 1,666,082 | 4/1928 | Bodmer | 8/118 |
| 2,506,046 | 5/1950 | Steinlin | 8/118 |
| 3,313,592 | 4/1967 | Canon et al. | 8/118 |

*Primary Examiner*—Maria Parrish Tungol

*Attorney, Agent, or Firm*—Wenderoth, Lind & Ponack

[57] ABSTRACT

A method for reforming a cellulose fiber cloth comprising applying an aqueous solution of a monocyclic aromatic hydrocarbon dissolved in a water soluble organic solvent to a cellulose fiber cloth and soaking the resultant cloth in a non-dried state with a concentrated sulfuric acid solution.

4 Claims, No Drawings

METHOD FOR REFORMING CELLULOSE FIBER CLOTH

BACKGROUND OF THE INVENTION

1. Field of the Invention

The present invention relates to a method for reforming a cellulose fiber cloth to give transparency and softness thereto.

2. Description of the Prior Art

Organdie finish has been well known as a treating process for giving transparency to a cellulose fiber cloth. The organdie finish is to treat a high grade cellulose fiber cloth of narrow yarn number count such as a lawn and voile with a concentrated aqueous solution of such inorganic acids as sulfuric acid and phosphoric acid or such inorganic salts as zinc chloride, ammonium thiocyanate and cuprammonium at a low temperature for reforming the cloth to give a transparent and hard feeling thereto and producing a cloth excellent in durability, linen touch, setting property, wash and wear property and cool feeling.

However, the products obtained by the conventional organdie finish have such defects that the feeling is too hard and creases are frequently caused to occur in drying, so that they are not suitable as a clothing and their uses are limited. Furthermore, since the cloth shrinks severely in the drying step of the said finishing treatment, the managements of the drying temperature and time are very difficult for controlling said shrinkage. Inconvenience also appears in the arrangement and preservation of the finished cloth.

SUMMARY OF THE INVENTION

Under such circumstances, the present invention is done for eliminating various problems as mentioned above in reforming a cellulose fiber cloth. The object of the present invention is to offer a reforming method of a cellulose fiber cloth with the use of an acid, in which a cloth having excellent transparency and feeling and widely applicable for clothings can be produced with no shrikage in the course of treatment.

The essential point of the invention comprises applying a monocyclic aromatic hydrocarbon dissolved in a water soluble organic solvent to a cellulose fiber cloth and soaking the resultant cloth in a non-dried state with a concentrated sulfuric acid solution.

DETAILED DESCRIPTION OF THE INVENTION

Natural and regenerated cellulose fibers are swollen and dissolved in a concentrated aqueous solution of an inorganic acid such as sulfuric acid and phosphoric acid and of an inorganic salt such as zinc chloride, ammonium thiocyanate and cuprammonium. Therefore, to obtain a desired transparent feeling in reforming a cellulose fiber cloth with the use of an inorganic acid or salt, it is necessary to treat the cloth for a short time at a low temperature for swelling the cloth to such a degree that only a part of the outer surface of the cellulose fibers is dissolved. When cellulose fibers are dissolved tolerably, the dissolved cellulose acts as an adhesive for adhering cellulose fibers at the fiber bundles and the contact surface of wefts and warps to form single yarns, and thus the cellulose fiber cloth shrinks remarkably in the drying step to form a film, missing the characteristic feature of the organdie finish of transparent feeling and lowering the expansion degree remarkably, and thus the cloth becomes useless as a clothing.

To prevent such drawbacks, a process has been proposed in that such an agent as formalin is added to the treating solution, and the treatment is done under the severe control of temperature and time. The product obtained in this way is excellent in its transparency, but the shrinkage is large in the drying step, making the cloth hard missing the feeling and pleasant touch for the use as a clothing, and causing difficulty in the arrangement of the product.

After the result of various studies, it is found in the present invention that, when a cellulose fiber cloth has been treated with a monocyclic aromatic hydrocarbon prior to the application of an acid thereto, the adhesion between the fibers can be prevented, and when no adhesion takes place between the fibers, a transparent and soft acid treated cloth can be produced with a slight shrinkage in the course of drying treatment.

In the present invention, a solution comprising a monocyclic aromatic hydrocarbon and a water soluble organic solvent is applied to a cellulose fiber cloth, which has been scoured and bleached as a usual way or further mercerized, uniformly by such means as spraying, padding and printing, and the resultant cloth is treated with a concentrated supfuric acid (47°-55° Bé) for 10 to 60 seconds at a temperature not higher than the ordinary temperature. The monocyclic aromatic hydrocarbon is one selected from the group consisting of benzene, toluene, o-xylene, m-xylene, p-xylene, ethylbenzene, hemimellitene, pseudocumene, mesithylene, cumene, durene, p-cymene, hexamethylbenzene, styrene and their substituted compounds with such radicals as halogen, benzene, nitrobenzene and the water soluble organic solvent is one selected from the group consisting of ether, alcohol, acetone, ethylene glycol, monoacetyl glycol, glacial acetic acid, 2-methyl-2, 3-butanediol, 1,5-pentanediol, propanol, dimethylformamide, dioxane, butyl-2-oxyethylamine and 2-nitroethanol.

As a result, a cellulose fiber cloth reformed with the use of sulfuric acid and having transparent and soft properties with little shrinkage in drying treatment can be produced skillfully.

In applying a monocyclic aromatic hydrocarbon alone prior to the treatment of a cellulose fiber cloth with sulfuric acid, the permeation of sulfuric acid to cellulose fibers is prevented, so that spots are formed frequently and the transparency is also insufficient in the cloth produced. In contrast to this, when a monocyclic aromatic hydrocarbon is used by dissolving it in a water soluble organic solvent, sulfuric acid permeates well in cellulose fibers, and a transparent and soft product can be produced uniformly.

DESCRIPTION OF THE PREFERRED EMBODIMENTS

Examples of the present inventive method will be compared with the conventional method in the following.

EXAMPLE 1

A cotton 100% lawn cloth on the market was desized, scoured and bleached. The treated cloth was immersed in a solution comprising 50 volume % o-xylene and 50 volume % ethyl alcohol, squeezed to 60% of the cloth in weight by using a mangle, and immediately treated with 52° Bé sulfuric acid for 30 seconds 25° C.

EXAMPLE 2

A solution comprising 50 volume % benzene, 20 volume % toluene and 30 volume % acetone was applied to a cloth as in Example 1 in an amount of 30 weight % of the cloth by spraying, and the resultant cloth was treated immediately with 52° Bé sulfuric acid for 30 seconds at 25° C.

CONVENTIONAL METHOD

A cloth as in Example 1 was treated with 52° Bé sulfuric acid comprising of 0.2% formalin for 45 seconds at 10° C. This process corresponds to the conventional organdie finish.

For the cloths obtained in the two examples and in the conventional method in the above and an untreated cloth, the transparency, shrinkage during the treatment, softness and wash and wear property (W & W) were studied. The result was as shown in Table 1.

TABLE 1

| | Transparency | Shrinkage | Softness | W & W |
|---|---|---|---|---|
| Untreated | no | 0 | 10° | no |
| Example 1 | yes | 8% | 15° | yes |
| Example 2 | yes | 10% | 18° | yes |
| Conventional | yes | 28% | 43° | yes |

Transparency: With the naked eye
Shrinkage: In drying the cloth at 90° C. under no tension
Softness: Folded angle in a test piece of 3 cm × 5 cm
Wash and wear property: With the naked eye As obvious from the above, in the present inventive reforming method of a cellulose fiber cloth, the shrinkage of the cloth during the treatment is small and the product is soft together with excellent transparency and wash and wear property as in the conventional organdie finish. Therefore, the cellulose fiber cloth treated by the present inventive reforming method can widely be applied for the use of various kinds of clothing.

What we claim:

1. A method for reforming a cellulose fiber cloth comprising applying a monocyclic aromtic hydrocarbon dissolved in a water soluble organic solvent to a cellulose fiber cloth and soaking the resultant cloth in a non-dried state with a concentrated sulfuric acid solution.

2. A method for reforming a cellulose fiber cloth according to claim 1, in which the monocyclic aromatic hydrocarbon is one selected from the group consisting of benzene, toluene, o-xylene, m-xylene, p-xylene, ethylbenzene, hemimellitene, pseudcumene, mesithylene, cumene, durene, p-cymene, hexamethylbenzene, styrene and their substituted compounds with such radicals as halogen, benzene and nitrobenzene.

3. A method for reforming a cellulose fiber cloth according to claim 1, in which the water soluble organic solvent is one selected from the group consisting of ether, alcohol, acetone, ethylene glycol, monoacetyl glycol, glacial acetic acid, 2-methyl-2, 3-butanediol, 1,5-pentanediol, propanol, dimethylformamide, dioxane, butyl-2-oxyethylamine and 2-nitroethanol.

4. A method for reforming a cellulose fiber cloth according to claim 1, in which the concentration of the sulfuric acid solution is from 47° to 55° Bé.

* * * * *